US009483027B2

(12) United States Patent
Marino

(10) Patent No.: US 9,483,027 B2
(45) Date of Patent: Nov. 1, 2016

(54) ONE-TOUCH COUNTDOWN TIMER

(71) Applicant: Jo-Anne Marino, Meredith, NH (US)

(72) Inventor: Jo-Anne Marino, Meredith, NH (US)

( * ) Notice: Subject to any disclaimer, the term of this patent is extended or adjusted under 35 U.S.C. 154(b) by 791 days.

(21) Appl. No.: 13/914,663

(22) Filed: Jun. 11, 2013

(65) Prior Publication Data

US 2014/0361638 A1 Dec. 11, 2014

(51) Int. Cl.
*G04F 1/00* (2006.01)

(52) U.S. Cl.
CPC ..... *G04F 1/005* (2013.01); *Y10T 307/944* (2015.04)

(58) Field of Classification Search
CPC ..... G04F 1/005; Y10T 307/944
See application file for complete search history.

(56) References Cited

U.S. PATENT DOCUMENTS 3,925,629 A 12/1975 Albinger
5,559,762 A * 9/1996 Sakamoto ..... G04G 13/021 368/251
6,140,620 A * 10/2000 Aldridge ..... F24C 7/08 219/414
6,798,631 B1 * 9/2004 Farsetta ..... G04G 15/003 361/115
8,046,575 B2 * 10/2011 Lin ..... G06F 11/1417 710/10
8,242,631 B2 * 8/2012 King ..... G04C 23/26 307/116
8,294,372 B2 * 10/2012 Yang ..... H05B 37/0281 315/133

* cited by examiner

*Primary Examiner* — Thienvu Tran
*Assistant Examiner* — Pinping Sun
(74) *Attorney, Agent, or Firm* — Frank Marino

(57) ABSTRACT

A plug-in wall timer has a prominent single "one touch" activator which causes a countdown period or varying length according to the number of times it is pressed, so that the timer's outlet may be energized only for that selected period. The device is simple to use, requires no programming, and operates independently of the current time of the day or day of the week.

4 Claims, 1 Drawing Sheet

ONE-TOUCH COUNTDOWN TIMER

FIELD OF THE INVENTION

The present invention is related to timers. More specifically, the invention is related to a timer for insertion into a standard AC wall outlet and having its own outlet into which may be plugged an electrical device for timed connection to the wall outlet there-through. Even more specifically, the invention is such a timer that has a prominent single "one touch" activator which causes a countdown period or varying length according to the number of times it is pressed, so that the timer's outlet is energized only for the desired length of time. The device is simpler to use and more reliable than prior art alternatives, requires no programming, and operates independently of the current time of the day or day of the week.

BACKGROUND

A problem common to many electrical devices is that they can be dangerous if left energized and unattended for extended periods after their use is finished. Attempts have been made to provide a timed outlet through which such a device is energized and de-energized, such as through the plug-in wall timer of U.S. Pat. No. 3,925,629 and many similar alternatives thereto, but such timers have proven to be replete with burdens and complexities far beyond those required to simply turn an appliance off after its use has ended.

Such timers as that of U.S. Pat. No. 3,925,629, including similar mechanically-driven versions and the digital counterparts thereto, are first plugged into an energized wall outlet, then programmed to reflect the correct current time of day, and then programmed with a daily turn-on time, and then programmed with a daily turn-off time. If the current time happens to be between the programmed turn-on and turn-off times, then the user often needs to wait until after the desired turn-off time to program the timer. Once the timer is properly programmed, its outlet will become energized every day from that same turn-on time to that same turn-off time. Some digital "seven day" counterparts allow for programming of different turn-on and turn-off times for weekend days, but those require additional programming even if those turn-on and turn-off times are the same as on the week days, and those require additional programming of the current day of the week.

If the wall outlet becomes de-energized at any time, such as during a power interruption, the programs so laboriously entered into these prior art timers are either lost completely (in the digital versions) or are at least delayed (in the mechanical versions) by the amount of time that power was lost. And all of this complex programming and opportunity for malfunction is suffered simply to ensure that a dangerous appliance is de-energized after use in case the operator forgets to turn the device off directly. Users rarely care what time of the day or day of the week this occurs, yet need to suffer through all this programming anyway.

Users oftentimes spend the day at work worrying that they may have left their coffee maker on at home, or left their pressing iron or hair curling iron on. Such anxiety has also surely forced many commuters to turn around for home after getting almost to work to be sure they are not going to come home to a house fire. While more expensive models of many "dangerous" appliances, like coffee makers, pressing irons, and hair curlers, are equipped with built-in shut-off timers, many models are not, especially including older devices still in use. And even appliances which are not dangerous when left operating, like TVs and lights, can waste large amounts of expensive power if left operating unattended at home through the workday.

Accordingly, disadvantages and flaws common to prior art appliance shut-off timers lie in their failure to provide simple, instant, and reliable selection of an operation turn-off point at which the appliance will become de-energized independent of the actual time of the day or day of the week. Further failures and disadvantages lie in the disproportionate degree of programming complexity in such timers compared to that actually deserved and required. Further failures and disadvantages lie in the disproportionate degree of functional complexity and cost in such timers compared to that actually deserved and required. Further failures and disadvantages lie in the disproportionate degree of user effort required by such timers compared to that actually deserved and required. Further disadvantages and flaws will be readily appreciated by those familiar with the art.

There exists a need to overcome all of these disadvantages and flaws and such is an object of the present invention. There exists a need for a plug-in wall timer that is simple to use, reliable, plugs into any standard AC wall outlet, receives any electrical device with a standard AC plug, requires no programming, and operates independently of the current time of the day or day of the week, and such are all objects of the invention. Further needs and objects exist which are addressed by the present invention, as may become apparent by the included disclosure of an exemplary embodiment thereof.

SUMMARY OF THE INVENTION

The invention may be practiced with or embodied by a plug-in wall timer with a housing containing a timing circuit and having front and rear faces. A set of male input blades extends from the rear face and is adapted for connection to a standard AC wall outlet. A set of female output terminals which may be on the front face is adapted for connection to a standard AC-operated electrical device. A lone electrical push-button switch is preferably disposed prominently on the front face. A display is preferably disposed prominently on the front face.

The timing circuit is controlled by the lone electrical push-button switch and is preferably arranged such that; momentarily pushing the lone electrical push-button switch a first time causes the set of female output terminals to be energized by the AC outlet for a first period of time and thereafter become de-energized and causes the display to indicate a remainder of the first period of time; momentarily pushing the lone electrical push-button switch additional times, up to a predetermined number of additional times, causes the set of female output terminals to be energized by the AC outlet for additional periods of time and thereafter become de-energized and causes the display to indicate a remainder of the first and additional periods of time; momentarily pushing the lone electrical push-button switch more than the predetermined number of additional times causes the set of female output terminals and display to be de-energized; pushing the lone electrical push-button switch and holding it in more than momentarily causes the set of female output terminals to become energized by the AC outlet for an extended period of time; and pushing the lone electrical push-button switch and holding it in more than momentarily during the indefinite period causes the set of female output terminals to become de-energized.

Further features and aspects of the invention are disclosed with more specificity in the Detailed Description and Drawings of an exemplary embodiment provided herein.

BRIEF DESCRIPTION OF THE DRAWINGS

Many aspects of the invention can be better understood with reference to the included drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
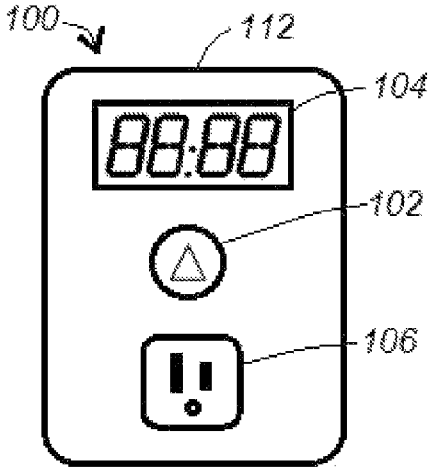
FIG. 1 is a front view of a one-touch countdown timer according to an exemplary embodiment.
Figure 2:
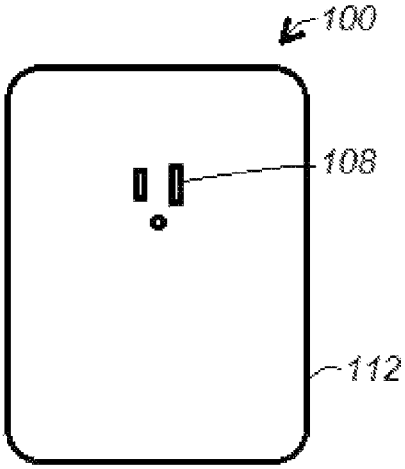
FIG. 2 is a rear view of the timer of FIG. 1.
Figure 3:
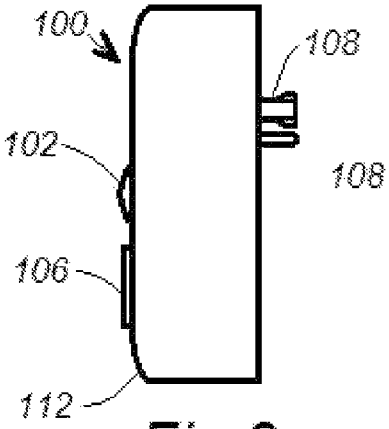
FIG. 3 is a side view of the timer of FIG. 1.

FIGS. 1 through 4 show an exemplary one-touch wall timer 100 according to just one of the infinite number of possible embodiments of the present invention. Housing 112 is approximately three inches tall, two inches wide, and one inch deep, and has extended from its rear side a set of standard AC wall plug blades 108, intended to be inserted into a standard AC wall outlet. Internal of the housing and not shown in FIG. 1 top 3 are electrical components that make up the circuit of FIG. 4. On the front side of the housing are only three features, control button 102, digital display 104, and power outlet 106.

While shown to include US-type NEMA 5-15 blades and outlet, it is anticipated that the type of connectors would be varied according to the region into which the timer is being marketed.

Figure 4:
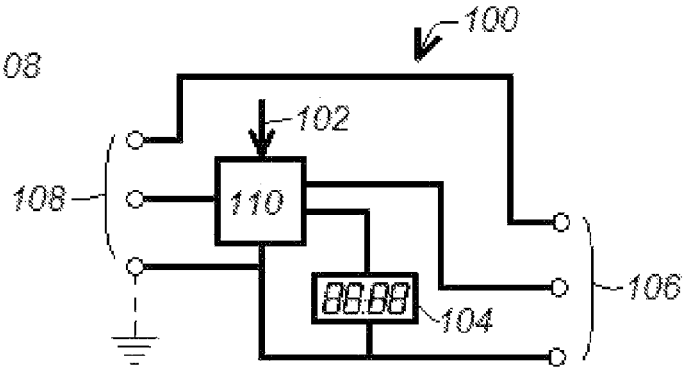
FIG. 4 is a circuit diagram of the timer of FIG. 1.

Referring to FIG. 4, a simplified exemplary schematic circuit diagram is provided. Sub-circuit 110 is preferably a customized IC including a solid state clock-driven thyristor to connect the AC source at 108 to the outlet at 106 and energize display 104 according to the input received from button 102. However, sub-circuit 110 could alternatively include more conventional electro-mechanical timing means, a relay, and supporting components, and could be disposed on a printed circuit board. Factors such as the intended load and the desired timing periods could render one arrangement more suitable than another for a particular embodiment of the timer. As such, the circuitry could take a virtually infinite number of forms in order to obtain the intended and herein-described functions, all well within the ordinary skill of an average circuit designer, so no limitation of the invention to the specific exemplary circuitry shown and described is intended.

When blades 108 are initially plugged into a standard energized AC wall outlet, the digital display 104 remains unlit, indicating that outlet 106 is not energized. If control button 102 is pressed only once, outlet 106 becomes energized and display 104 initially indicates "10:00". The display starts counting down as each second passes thereafter; "09:59", "09:58", "09:57", "09:56", etc, until "00:00" is reached and outlet 106 then becomes de-energized.

Alternatively, control button 102 may be successively pressed more than once to energize outlet 106 for a longer period, with each pressing causing an additional ten minutes of energization for up to one hour. For example, if control button 102 is pressed twice, outlet 106 becomes energized and display 104 initially indicates "20:00". The display starts counting down "19:59", "19:58", "19:57", "19:56", etc, until "00:00" is reached and outlet 106 then becomes de-energized. While the ten-minute initial and additional periods are preferred, they are of course not meant to be limiting. The periods could be one minute, one hour, one day, etc, according to the electrical device for which a particular embodiment of the timer was intended.

At any time before reaching "00:00", pressing button 106 will add ten minutes to the display and the time left of the outlet's energization. If button 106 is initially pressed successively seven times or is pressed during operation to a time of operation beyond one hour, the timer will be reset and will de-energize outlet 106 and display 104 and the user must wait one second to resume operation. Again, this one hour limit is preferred, but may be different for a different application of the invention. If at any time button 102 is pressed and held in for more than one second, then outlet 106 is indefinitely energized (always on) and the display indicates "88:88". Pressing and holding button 102 again during this "always on" period will de-energize outlet 106 and turn off display 104 and the user must then wait one second to resume operation.

Operation of the timer is unrelated to and independent of any particular time of the day or day of the week. If, for instance, a user intends to curl her hair with a curling iron prior to leaving for work and expects the process to require eight minutes, she simply plugs the curling iron into outlet 106 and presses button 102 one time. She then uses the curling iron as usual, and turns it off when she finished curling her hair, as usual. However, in the event that she forgets to turn off the curler, she can rest assured that it will be turned off by the timer after ten minutes. If a user wishes to brew a pot of coffee on a Saturday morning and have a cup before heading out to run the day's errands, he simply plugs the maker into outlet 106 and presses button 102 say six times, enjoys the coffee once it is brewed, and heads out with the comfort of knowing that the coffee maker was turned off by the timer after one hour. No complicated programming is required and no angst results for the uncertainty of wondering whether the timer was properly programmed.

It should be understood that the invention is not limited to the precise embodiment described above, and that various changes and modifications thereof may be effected by one skilled in the art without departing from the spirit or scope of the invention. The invention should therefore only be limited according to the following claims, including all equivalent interpretation to which they are entitled.

I claim:

1. A timer comprising a singular housing comprising: a set of male input blades adapted for connection to a standard electrical power outlet; a set of female output terminals adapted to receive an electrical device; an electrical push-button switch; a timing circuit controlled by the push-button switch such that pushing the push-button switch a first time causes the set of female output terminals to be energized by the AC outlet for a first period of time and thereafter become de-energized; wherein the timing circuit is further controlled by the push-button switch such that pushing the push-button switch and holding it in causes the set of female output terminals to become energized by the AC outlet for an extended period of time; and wherein the extended period of time is an indefinite period of time and wherein the timing circuit is further controlled by the push-button switch such that pushing the push-button switch and holding it in during the indefinite period causes the set of female output terminals to become de-energized.

2. A timer comprising a singular housing comprising: a set of male input blades adapted for connection to a standard electrical power outlet; a set of female output terminals adapted to receive an electrical device; an electrical push-button switch; a timing circuit controlled by the push-button switch such that pushing the push-button switch a first time causes the set of female output terminals to be energized by the AC outlet for a first period of time and thereafter become de-energized; further comprising a display that provides a running indication of a remainder of the first period of time; wherein the timing circuit is further controlled by the push-button switch such that pushing the push-button switch and holding it in causes the set of female output terminals to become energized by the AC outlet for an extended period of time; and wherein the extended period of time is an indefinite period of time and wherein the timing circuit is further controlled by the push-button switch such that pushing the push-button switch and holding it in during the indefinite period causes the set of female output terminals to become de-energized.

3. A timer comprising a singular housing comprising: a set of male input blades adapted for connection to a standard electrical power outlet; a set of female output terminals adapted to receive an electrical device; an electrical push-button switch; a timing circuit controlled by the push-button switch such that pushing the push-button switch a first time causes the set of female output terminals to be energized by the AC outlet for a first period of time and thereafter become de-energized; wherein the housing comprises a front face disposed opposite the set of male input blades; wherein the front face comprises the push-button switch; wherein the timing circuit is further controlled by the push-button switch such that pushing the push-button switch and holding it in causes the set of female output terminals to become energized by the AC outlet for an extended period of time; wherein the extended period of time is an indefinite period of time and wherein the timing circuit is further controlled by the push-button switch such that pushing the push-button switch and holding it in during the indefinite period causes the set of female output terminals to become de-energized.

4. A plug-in wall timer comprising: a housing containing a timing circuit and having front and rear faces; a set of male input blades extending from the rear face and adapted for connection to a standard AC wall outlet; a set of female output terminals on the front face adapted to receive an electrical device; a lone electrical push-button switch on the front face; a display on the front face; wherein the timing circuit is controlled by the push-button switch such that; pushing the lone electrical push-button switch a first time causes the set of female output terminals to be energized by the AC outlet for a first period of time and thereafter become de-energized and causes the display to indicate a remainder of the first period of time; pushing the lone electrical push-button switch additional times, up to a predetermined number of additional times, causes the set of female output terminals to be energized by the AC outlet for additional periods of time and thereafter become de-energized and causes the display to indicate a remainder of the first and additional periods of time; pushing the lone electrical push-button switch more than the predetermined number of additional times causes the set of female output terminals and display to be de-energized; pushing the lone electrical push-button switch and holding it causes the set of female output terminals to become energized by the AC outlet for an extended period of time; and pushing the lone electrical push-button switch and holding it in during an indefinite period causes the set of female output terminals to become de-energized.

* * * * *